US006311907B1

(12) United States Patent
Gingras

(10) Patent No.: US 6,311,907 B1
(45) Date of Patent: Nov. 6, 2001

(54) REFINER PLATE WITH CHICANES

(75) Inventor: Luc Gingras, Horsforth (GB)

(73) Assignee: Durametal Corporation, Tualatin, OR (US)

( * ) Notice: Subject to any disclaimer, the term of this patent is extended or adjusted under 35 U.S.C. 154(b) by 0 days.

(21) Appl. No.: 09/485,741

(22) PCT Filed: Aug. 19, 1998

(86) PCT No.: PCT/US98/17162

§ 371 Date: Feb. 15, 2000

§ 102(e) Date: Feb. 15, 2000

(87) PCT Pub. No.: WO00/11264

PCT Pub. Date: Mar. 2, 2000

(51) Int. Cl.[7] ..... B02C 7/12
(52) U.S. Cl. ..... 241/28; 241/261.3; 241/298
(58) Field of Search ..... 241/28, 261.2, 241/261.3, 296, 297, 298

(56) References Cited

U.S. PATENT DOCUMENTS

| | | | |
|---|---|---|---|
| 1,114,339 | 10/1914 | Bryant . | |
| 5,373,995 | 12/1994 | Johannson . | |
| 5,425,508 * | 6/1995 | Chaney | 241/261.2 |

FOREIGN PATENT DOCUMENTS

| | | |
|---|---|---|
| 0 179 041 | 4/1986 | (EP) . |
| WO 88/06490 | 9/1988 | (SE) . |

* cited by examiner

*Primary Examiner*—Mark Rosenbaum
(74) *Attorney, Agent, or Firm*—Alix, Yale & Ristas, LLP

(57) ABSTRACT

A refiner plate for the face of a refiner disc comprising a plurality of refiner segments arranged side-by-side on the face of the disc to form a substantially annular refining region. Each refiner segment has a plurality bars, chicanes and grooves for refining a lignocellulosic material and forming a zig-zag path for receiving and transmitting steam generated during the refining process. The chicanes define a series of substantially arcuate lines extending from a position intermediate the junction of the inlet and refining zones to the outer edge of the refiner plate in the counter-rotation direction.

16 Claims, 4 Drawing Sheets

REFINER PLATE WITH CHICANES

CROSS-REFERENCE TO RELATED APPLICATIONS

This is the national stage of International Application No. PCT/US98/17162 filed Aug. 19, 1998.

BACKGROUND OF THE INVENTION

The present invention relates generally to disc refiners for lignocellulosic material. More particularly, the present invention relates to refiner plate segments for such an apparatus.

In high consistency mechanical pulp refiners, the wood fibers are worked between two relatively rotating discs on which refiner plates are mounted. The plates usually have radial bars and grooves. A large volume of steam is produced between the plates as a result of this refining work. For effective refining, the fibrous material must be retained between the plates on the bar surfaces despite the high velocity of the flowing steam, and the enormous centrifugal forces. Typically, the steam is exhausted via the grooves, and dams are provided in the grooves to interrupt material flow and thus improve the retention time of the material in the refining region.

In a typical refiner plate with radial bars and grooves, the bars provide impacts or pressure pulses which separate and fibrillate the fibers. The grooves enable radially directed feeding of the fibers and steam extraction. Near the perimeter of the plates, high radial steam flow and high centrifugal force both act to sweep the fibers outwardly from between the plates prematurely, thus reducing the refining effectiveness. The flow restrictions due to a small gap between opposed plates and fiber-filled grooves result in a steam pressure peak between the plates, located radially inward from the perimeter. This pressure peak is a major source of the refining thrust load, and can induce control instability at high motor loads. It is thus desirable that the steam generated during refining be discharged from the refining region as quickly as possible, while retaining the pulp within the region as long as possible.

SUMMARY OF THE INVENTION

Briefly stated, the invention includes a refiner plate which is constituted from a plurality of refiner plate segments, each of the segments formed with a pattern including a refining zone having a plurality of radially disposed bar segments. Each of the bar segments has oppositely disposed radially inner and outer ends. A chicane extends obliquely from the outer end of an inner bar segment to the inner end of an outer bar segment to form a zig-zag shaped rib. Adjacent ribs define a plurality of zig-zag shaped grooves alternating with the ribs. The chicanes define at least one substantially arcuate line extending radially and laterally across at least the refining zone.

It is an object of the present invention to provide a refiner plate for the face of a refiner disc, which facilitates the removal of steam while retaining the pulp in the refiner region to achieve satisfactory pulp quality.

This object is achieved by, in a preferred form, by providing chicanes that form a zig-zag flow path for most of the steam generated during the refining operation. A sloping leading face on each chicane directs the flow of the lignocellulosic material into the gap between the refiner plates for comminution on the grinding surfaces of the bars. Although the upwelling of lignocellulosic material into the refining gap restricts flow of steam through the gap in the vicinity of the chicanes, the chicanes are positioned to form arcuate lines extending to the peripheral edge of the disc. Consequently, steam may flow in the gap to the edge of the disc in the arcuate corridors formed between the lines of chicanes.

Accordingly, the object of achieving good fiber quality with good steam management is accomplished by providing chicanes that direct the fiber into contact with the grinding surface while providing a plurality of flow paths for directing steam through the refining gap to the peripheral edge of the disc. To the inventor's knowledge, no one previously provided chicanes that are distributed in a manner that facilitates steam flow in the refining gap.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
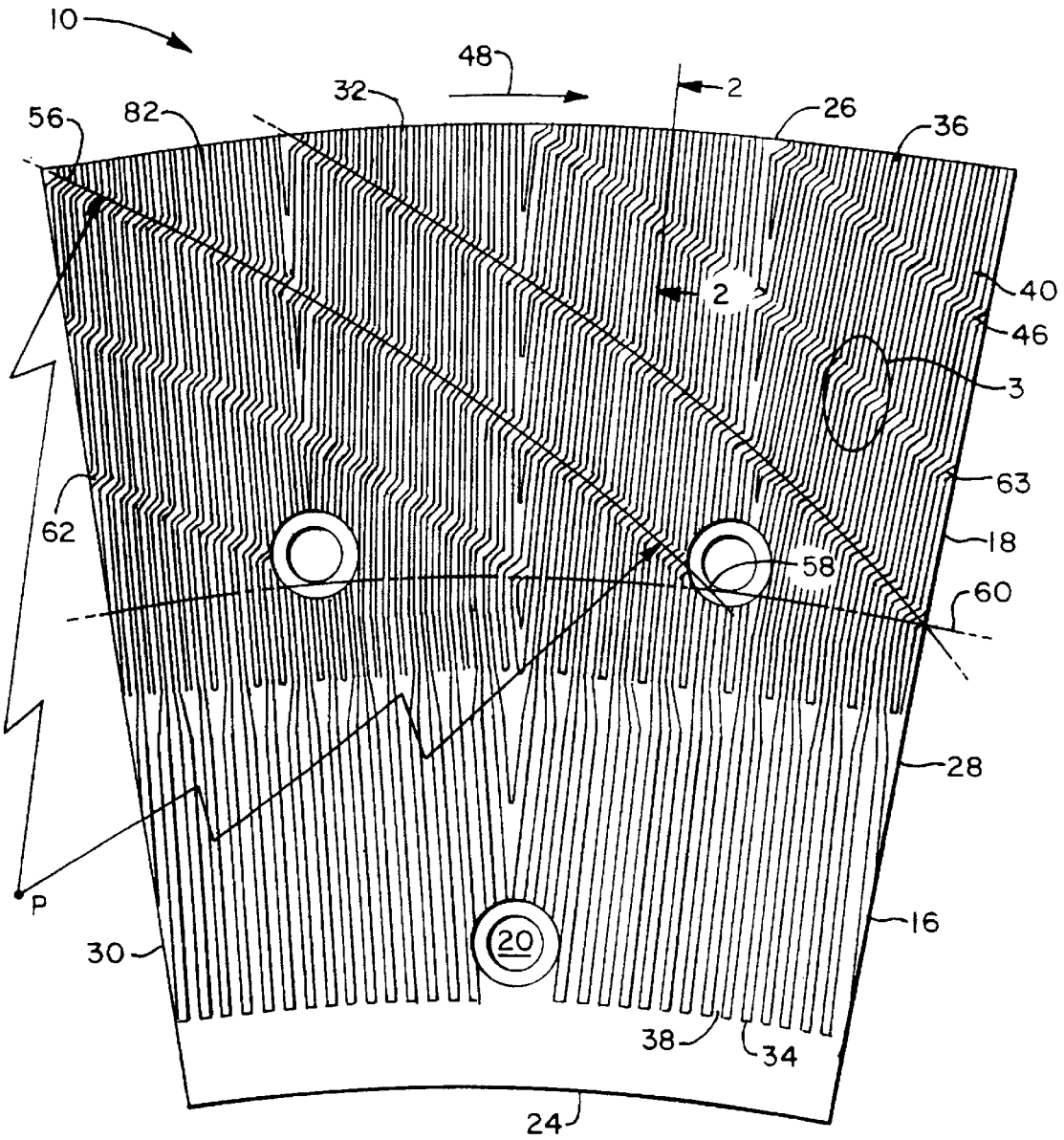
FIG. 1 is an elevation view of a refiner plate segment in accordance with the invention.
Figure 2:
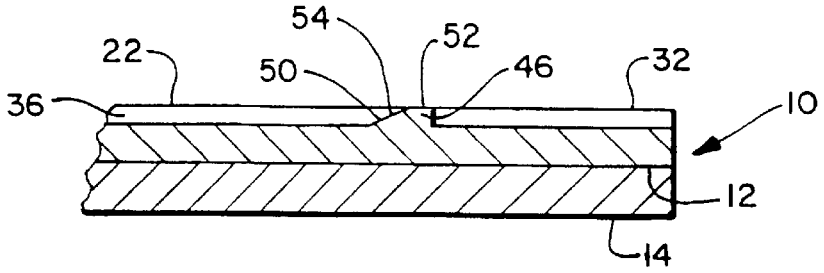
FIG. 2 is an enlarged section view along line 2—2 of FIG. 1.

With reference to the drawings wherein like numerals represent like parts throughout the several figures, a refiner plate in accordance with the present invention comprises a plurality of refiner plate segments 10 which are securable to the front face 12 of a substantially circular refiner disc 14 (FIG. 2). Although in the illustrated embodiment each segment 10 has two zones 16, 18 each having a differently oriented set of patterns, each segment 10 could alternatively have a single or three or more zones having respective sets of patterns (FIG. 1).

The plate segments 10 are attached to the disc face 12, in any convenient or conventional manner, such as by bolts (not shown) passing through bores 20. One end of the bolt engages the disc 14 and at the other end has head structure bearing against a countersunk surface. The disc 14, only a portion of which is shown, has a center about which the disc rotates, and a substantially circular periphery. The refiner plate segments 10 are arranged side-by-side on the face 12 of the disc 14, to form a substantially annular refiner face, shown generally at 22 (FIG. 2). The face 22 forms a portion of a refiner region, when confronting another refiner plate (not shown) carried by another disc.

Figure 4:
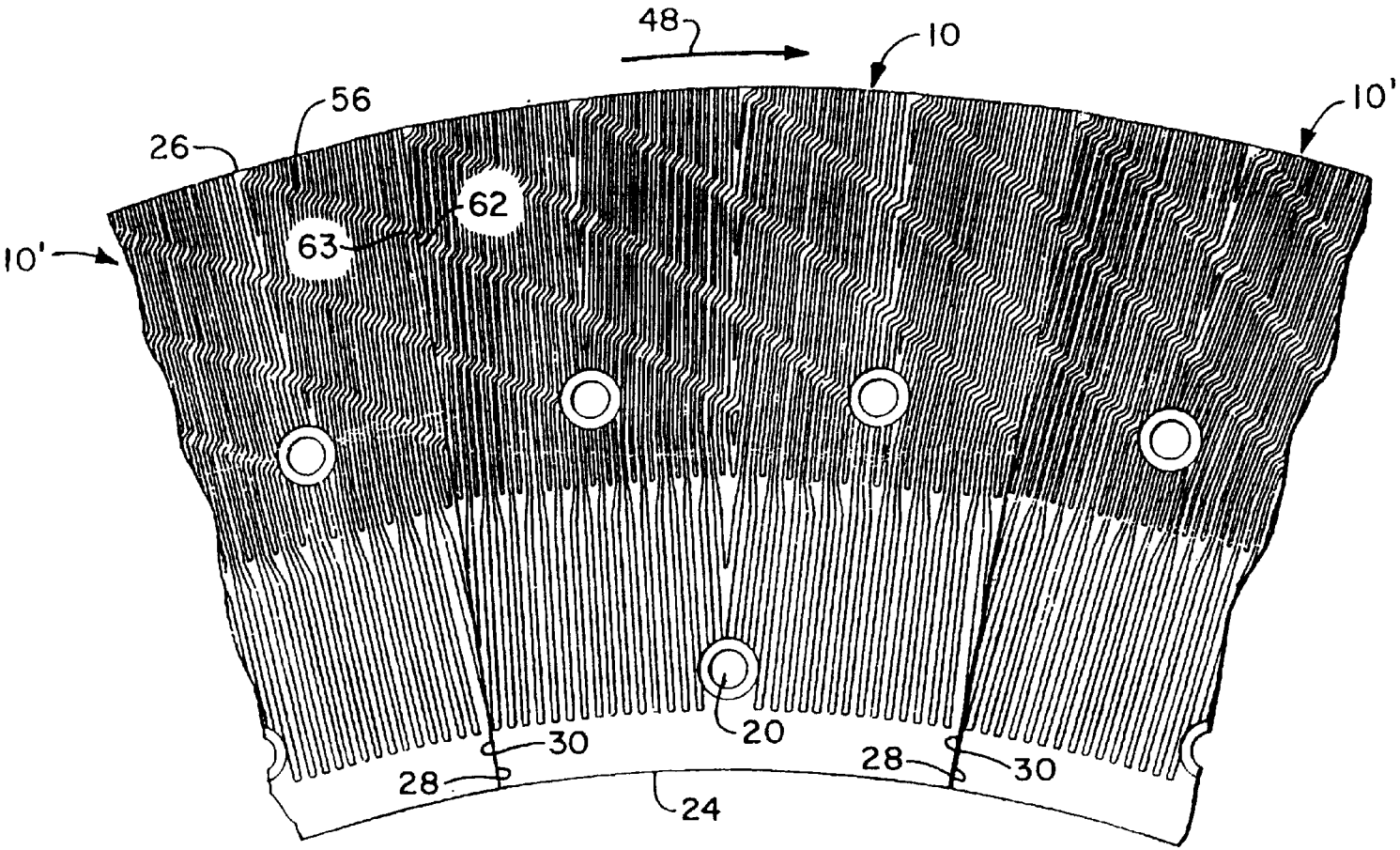
FIG. 4 is an elevation view, partly broken away of a refiner plate including a plurality of the refiner plate segments in accordance with the invention.

With reference to FIG. 1, each refiner plate segment 10 has an inner edge 24 near the center of the disc, an outer edge 26 near the periphery of the disc, and leading and trailing side edges 28, 30 which abut the trailing and leading side edges 30, 28 of adjacent refiner plate segments 10', respectively (FIG. 4). The remainder of this description will refer to a single plate segment 10, but it should be understood that all the segments which define the annular plate, are preferably substantially similar. The bars 32, 34 and grooves 36, 38 extend substantially radially, i.e., radially, or parallel to a radius of the disc, or obliquely at an acute angle to such a radius. The plate segment 10 has, on its face, at least one, and preferably two or three, distinct patterns of bars and grooves between the bars, whereby material to be refined can flow in the grooves in the general direction from the inner edge 24 to the outer edge 26 of the plate segment 10, 10'.

A first or inlet zone 16 has a multiplicity of bars 34 and grooves 38 between adjacent bars 34, all of which extend substantially in the radial direction. This pattern is especially adapted for receiving wood chips, wood pulp, or the like and performing an initial refining operation thereon to reduce the size of the material and funnel it radially outward into a second, refining zone 18. The refining zone 18 has a multiplicity of bars 32 and grooves 36 between adjacent bars 32, which also extend in parallel, substantially radially. A third, outer zone (not shown) may be provided between the refining zone 18 and the outer edge 26 of the plate. As shown in FIG. 1, each zone 16, 18 may comprise a plurality of fields, where each field has a uniform pattern. In the embodiment shown in FIG. 1, the segment has two fields in each zone. The patterns promote the flow of steam radially outward to the outer edge 26 of the disc 14 and radially inward to the inner edge 24 of the disc 14 for evacuation while retarding the flow of material to ensure that the material is fully refined.

Since the disc 14 and plate rotate, the partially refined material is directed, as a result of centrifugal force, radially outward. Substantial quantities of steam are also generated in the refining zone 18 producing a steam flow with high radial velocity. Especially with relatively large discs, the centrifugal forces acting on the steam and partially refined chips increase dramatically as the material moves farther and farther radially outward. Although it is highly desirable that the steam be quickly exhausted from the refining region, it is essential that the partially refined fibers not be prematurely exhausted along with the steam. This condition is influenced by the radial pressure profile along the disc face 22 due to steam generated by the refining at high consistency. Since the pressure peak is between the inner and outer edges 24, 26 of the plate, the steam flows forward (radially outward) from the outer side of the pressure peak and backward (radially inward) inside the pressure peak, against the material feed.

Figure 3:
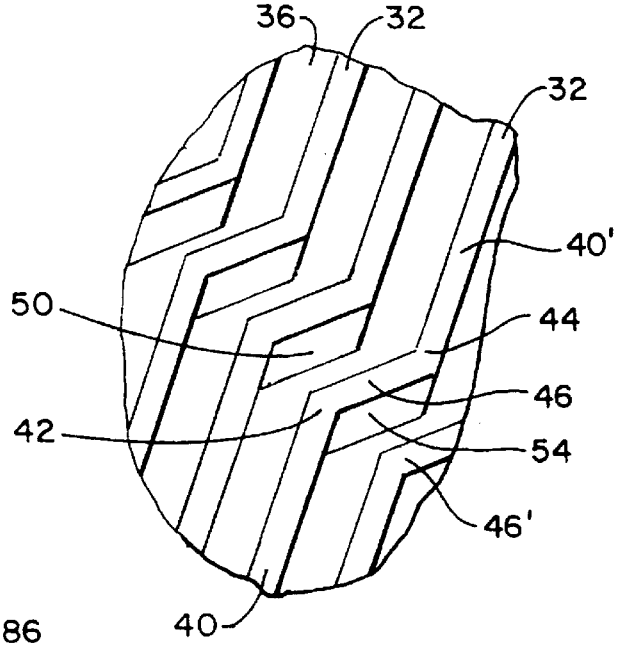
FIG. 3 is an enlarged elevation view of Area 3 of FIG. 1.

In a first embodiment of the invention, the refining zone 18 of the refiner plate segment 10 includes a plurality of radially extending first rib segments 40. With reference to FIG. 3, each first rib segment 40 is connected at its radially outer end 42 to the radially inner end 44 of the next outer first rib segment 40' by a chicane 46. Each chicane 46 comprises a second rib segment that extends obliquely in the direction of disc rotation 48 from the inner first rib segment 40 to the outer first rib segment 40' to form a radially extending zig-zag bar 32. With further reference to FIG. 2, the inner side 50 of each chicane 46 slopes from the top 52 of the chicane 46 toward the adjacent chicane 46' to form a ramp face 54.

The grooves 36 formed between adjoining ribs 32 define a zig-zag path substantially across the refining zone 18 for the movement of fibers. The lignocellulosic material traveling in the groove 36 is drawn into the corner of the chicane 46 and up the ramp face 54 of the chicane 46 by centrifugal force. The lignocellulosic material is therefore directed into the space or gap between the opposing refiner plates for additional comminution. The zig-zag path therefore retards movement of the lignocellulosic material, preventing material from exiting the refiner without having being sufficiently refined. The majority of the steam, which is less affected by the centrifugal force, continues traveling in the groove 36 to the periphery of the plate where it exits the refiner.

With reference to FIG. 1, the chicanes 46 define a series of substantially arcuate lines 56. In the embodiment shown in FIG. 1, the radially innermost end 58 of the lines 56 define an arc segment 60 positioned intermediate the outer edge 26 of the plate and the junction of the inlet and refining zones 16, 18. Each of the lines 56 extends from the arc segment 60 in the direction opposite to the direction of rotation 48 of the disc to the outer edge 26 of the plate such that the arc formed by the line of chicanes 46 has a substantially uniform radius from a point P. The chicanes 46 of the present invention cause an upwelling of feed material that constricts the plate gap in the vicinity of the chicanes 46. However, steam generated during the refining operation may flow radially through the corridor 82 between the lines 56, 56' of chicanes 46. Alternatively, the inner most end of the lines of chicanes 46 may be positioned at the junction of the inlet and refining zones 16, 18 and the lines may not extend to the outer edge 26.

Figure 6:
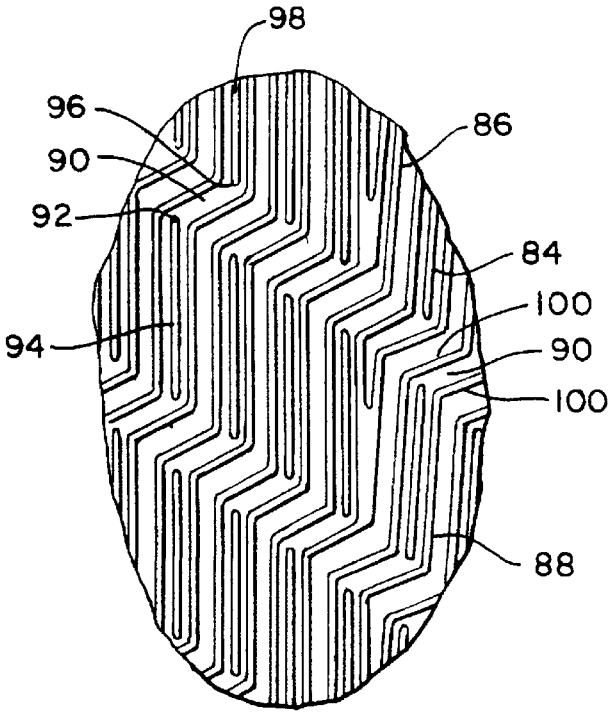
FIG. 6 is an enlarged elevation view of Area 6 of FIG. 5.
Figure 5:
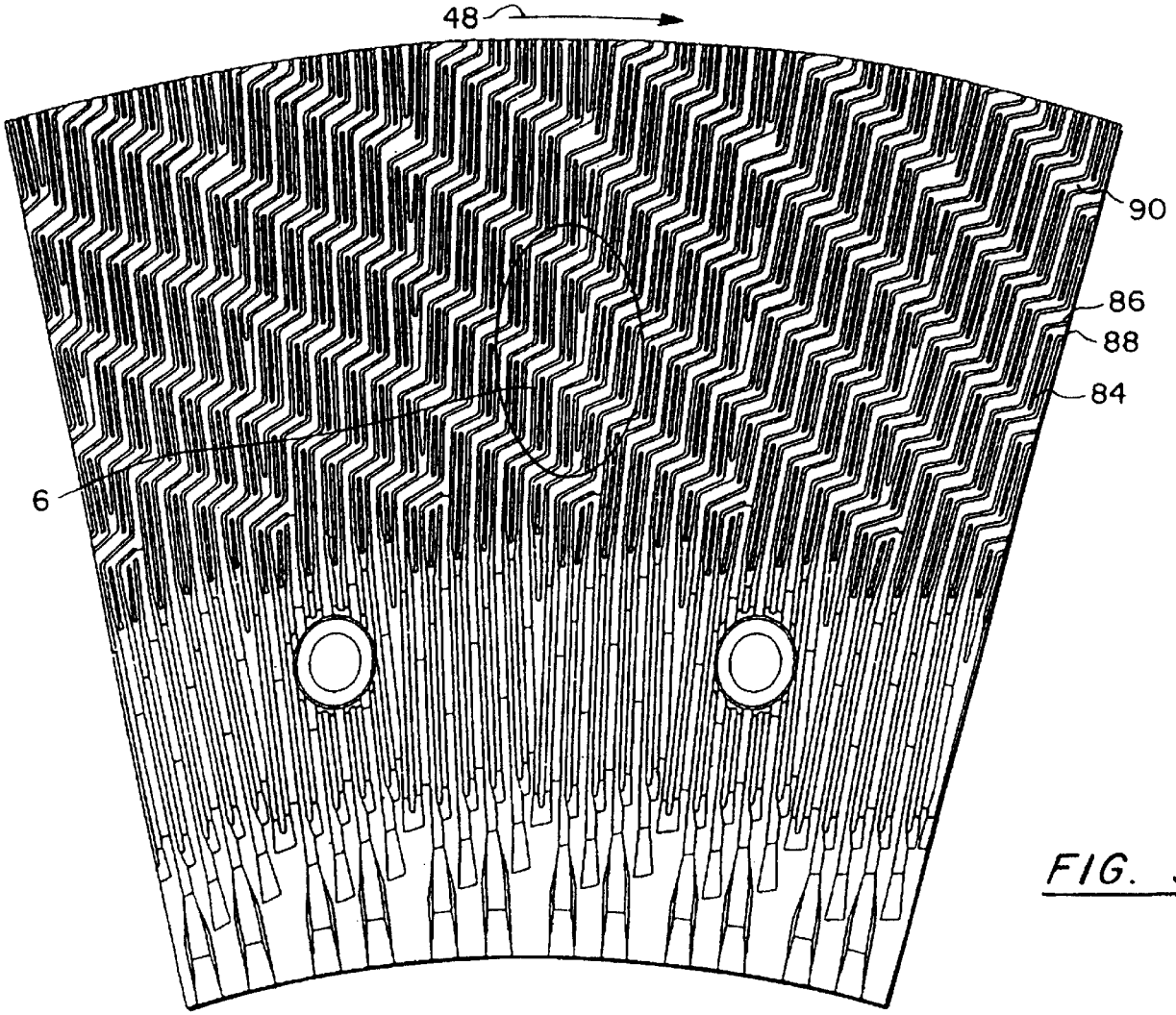
FIG. 5 is an elevation view of an alternate embodiment of the refiner plate segment of FIG. 1.

In the embodiment shown in FIGS. 5 and 6, interrupted bars 84 may be disposed intermediate pairs of zig-zag bars 86, 88. The interrupted bars 84 are formed by providing a gap 90 between the radially outer end 92 of an inner rib segment 94 and the radially inner end 96 of an outer rib segment 98. The gaps 90 are disposed intermediate the chicanes 100 of the zig-zag bar pair 86, 88 and therefore extend obliquely in the direction of disc rotation 48.

With further reference to FIG. 4, the radially outer end 62 of each line 56 of chicanes 46 that terminate on the trailing side edge 30 of a refiner plate segment 10 is positioned adjacent the radially inner end 63 of a line 56 of chicanes 46 on the leading side edge 28 of the adjacent refiner plate segment 10'. Consequently, the line of chicanes 56 may extend across two refiner plate segments 10, 10' to provide a continuous line from the arc segment to the outer edge 26 of the plate.

While preferred embodiments have been shown and described, various modifications and substitutions may be made thereto without departing from the spirit and scope of the invention. For example, the present invention may also advantageously implemented on a three zone segment. Accordingly, it is to be understood that the present invention has been described by way of illustration and not limitation.

What is claimed is:

1. A refiner plate segment for refining lignocellulosic material, comprising a refining zone having:

radially inner and outer ends;

a plurality of substantially radially disposed rib segments, each of said rib segments having oppositely disposed radially inner and outer ends;

a plurality of chicanes, each of said chicanes extending obliquely from said radially outer end of an inner rib segment to said radially inner end of an outer rib segment to form a zig-zag shaped bar;

a plurality of zig-zag shaped grooves disposed intermediate adjacent said bars;

wherein said chicanes define at least one substantially arcuate line extending radially and laterally across at least a portion of said refining zone.

2. The refiner segment of claim 1 wherein said segment is rotatable in a direction of rotation and wherein said chicanes extend in the direction of rotation.

3. The refiner segment of claim 2 wherein said at least one line extends in a direction opposite to said direction of rotation.

4. The refiner segment of claim 1 wherein each of said chicanes comprises a top surface and a leading side, said leading side sloping from said top surface toward an adjacent chicane to form a ramp face.

5. The refiner segment of claim 1 wherein said chicanes define a plurality of substantially arcuate lines extending radially and laterally across said segment.

6. The refiner segment of claim 1 wherein said line of chicanes extends from a point intermediate said inner and outer ends of said refining zone to said outer end of said refining zone.

7. The refiner segment of claim 1 wherein said refining zone defines a plurality of gaps extending obliquely from said radially outer end of an inner rib segment to said radially inner end of an outer rib segment to form at least one interrupted bar, said interrupted bar being disposed intermediate a pair zig-zag shaped bars.

8. A refiner having relatively rotating opposed discs, each of said discs having an outer edge, a refining zone, and carrying plates formed by a plurality of plate segments for refining lignocellulosic material wherein each plate segment comprises a plurality of substantially radially disposed rib segments, each of said rib segments having oppositely disposed radially inner and outer ends, a plurality of chicanes, each of said chicanes extending obliquely from said radially outer end of an inner rib segment to said radially inner end of an outer rib segment to form a zig-zag shaped bar, and a plurality of zig-zag shaped grooves alternating with said bars, wherein said chicanes define a plurality of substantially arcuate lines extending radially and laterally across said refining zone.

9. The refiner of claim 8 wherein at least one of said discs is rotatable in a direction of rotation and wherein said chicanes extend in said direction of rotation.

10. The refiner segment of claim 9 wherein said lines extend in a direction opposite to said direction of rotation.

11. The refiner of claim 10 wherein said plurality of plate segments comprises first and second plate segments, each of said plate segments having a leading edge and a trailing edge, said trailing edge of said first plate segment being adjacent said leading edge of said second plate segment, at least one of said lines includes a first portion having an outer end terminating at said trailing edge of said first plate segment and a second portion having an inner end beginning at said leading edge of said second plate segment.

12. The refiner of claim 11 wherein said outer end of said first portion is disposed adjacent said inner end of said second portion to form a continuous line.

13. The refiner of claim 8 wherein said disc further comprises a radially inner inlet zone for receiving the lignocellulosic material and a radially outer refining zone for refining the lignocellulosic material, said rib segments and said chicanes being disposed in said refining zone.

14. The refiner of claim 13 wherein each of said lines has a radially inner end positioned intermediate said edge of said disc and said inlet zone and each of said lines extends to said edge of said disc.

15. The refiner of claim 8 wherein said opposed discs define a refining gap and said lines of said chicanes define a plurality of flow corridors in said refining gap.

16. A method for directing the flow of feed material and steam, generated between a pair of relatively rotating opposed refining discs defining a refining gap, during refining of a lignocellulosic material in a refiner, each of the discs having radially inner and outer edges and a face pattern including a refining zone having a plurality of substantially radially disposed rib segments, each of the rib segments having oppositely disposed radially inner and outer ends, a plurality of chicanes, each of the chicanes extending obliquely from the radially outer end of an inner rib segment to the radially inner end of an outer rib segment to form a zig-zag shaped bar having an upper grinding surface, the chicanes having a sloped leading face and defining a plurality of substantially arcuate lines extending radially and laterally across the refining zone to the edge of the disc, and a plurality of zig-zag shaped grooves alternating with the bars, the method comprising the steps of 1) directing the feed material up the sloped leading face of the chicane to the refining gap with a centrifugal force generated by rotating at least one of the refining discs for comminution on the grinding surface of the bar;
2) directing a first portion of the steam through the grooves to the outer edge of the discs with the centrifugal force and thereby removing the first portion of the steam from between the discs; and
3) directing a second portion of the steam through the refining gap intermediate adjacent lines of chicanes to the outer edge of the discs with the centrifugal force and thereby removing the second portion of the steam from between the discs.

* * * * *